US006755583B1

(12) United States Patent
Maruyama

(10) Patent No.: US 6,755,583 B1
(45) Date of Patent: Jun. 29, 2004

(54) ROLL-LIKE PRINTING PAPER, VIDEO PRINTER USING SUCH ROLL-LIKE PRINTING PAPER AND METHOD OF DETECTING REMAINING QUANTITY OF PRINTING PAPER

(75) Inventor: Masahide Maruyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 129 days.

(21) Appl. No.: 09/590,641

(22) Filed: Jun. 8, 2000

(30) Foreign Application Priority Data

Jun. 8, 1999 (JP) ..... P11-161588

(51) Int. Cl.[7] ..... B41J 15/02
(52) U.S. Cl. ..... 400/613; 400/611
(58) Field of Search ..... 400/611, 613, 400/201, 219, 218.1, 219.2, 219.3, 219.4, 219.5; 347/215

(56) References Cited

U.S. PATENT DOCUMENTS

| | | | | | |
|---|---|---|---|---|---|
| 4,925,121 | A | * | 5/1990 | Tapscott et al. | 242/563.2 |
| 5,281,991 | A | * | 1/1994 | Oonishi et al. | 355/29 |
| 5,326,182 | A | * | 7/1994 | Hagstrom | 400/223 |
| 5,352,900 | A | * | 10/1994 | Dragon et al. | 250/261 |
| 5,370,049 | A | * | 12/1994 | Oshino et al. | 101/288 |
| 5,393,149 | A | * | 2/1995 | Iima | 400/208 |
| 5,517,915 | A | * | 5/1996 | Oshino et al. | 101/288 |
| 5,743,664 | A | * | 4/1998 | Small | 400/249 |
| 6,092,940 | A | * | 7/2000 | Wiklof et al. | 400/88 |
| 6,099,178 | A | * | 8/2000 | Spurr et al. | 400/207 |
| 6,164,851 | A | * | 12/2000 | Sakamoto et al. | 400/207 |
| 6,179,245 | B1 | * | 1/2001 | Ripplinger | 242/614.1 |
| 6,224,276 | B1 | * | 5/2001 | Funayama et al. | 400/227.1 |
| 6,250,826 | B1 | * | 6/2001 | Kato | 400/237 |

FOREIGN PATENT DOCUMENTS

| | | | | |
|---|---|---|---|---|
| EP | 0 401 036 A1 | * | 1/1990 | B65H/75/14 |
| EP | 401036 A | * | 12/1990 | B41J/15/02 |
| GB | 2184708 A | | 6/1986 | |
| GB | 2263467 A | | 11/1992 | |
| GB | 2263467 A | * | 7/1993 | B41J/32/00 |
| JP | 62111861 | | 5/1987 | |
| JP | 2137969 | | 5/1990 | |
| JP | 03-205174 | * | 9/1991 | B41J/17/02 |
| JP | 8273245 | | 10/1996 | |

* cited by examiner

*Primary Examiner*—Daniel J. Colilla
(74) *Attorney, Agent, or Firm*—Reed Smith LLP

(57) ABSTRACT

The present invention relates to a roll-like printing paper, a video printer using such roll-like printing paper and a method of detecting a remaining quantity of a roll-like printing paper. More specifically, this invention relates to a roll-like printing paper in which a paper spool may include a detection portion for detecting a rotation of the paper spool and a rotation of the paper spool can be detected by this detection portion. Further, this invention relates to a video printer and a printing paper remaining quantity detection method in which the rotation of the paper spool of this roll-like printing paper may be detected and an alarm may be displayed if it is determined based on the detected paper spool rotation that the remaining quantity of the roll-like printing paper approaches to its end.

19 Claims, 11 Drawing Sheets

ROLL-LIKE PRINTING PAPER, VIDEO PRINTER USING SUCH ROLL-LIKE PRINTING PAPER AND METHOD OF DETECTING REMAINING QUANTITY OF PRINTING PAPER

BACKGROUND OF THE INVENTION

1. Field of the Invention

The present invention generally relates to a roll-like printing paper wound around a paper spool, a video printer using such roll-like printing paper and a method of detecting a remaining quantity of a roll-like printing paper. More particularly, this invention relates to a roll-like printing paper having a detection portion formed on a paper spool to detect a rotation of the paper spool wherein the rotation of the paper spool can be detected by the detection portion and a video printer and a method of detecting a remaining quantity of a printing paper in which a rotation of a paper spool of this roll-like printing paper is detected and an alarm is displayed if it is determined based on the detected paper spool rotation that the remaining quantity of the roll-like printing paper approaches to its end.

2. Description of the Related Art

Heretofore, there has been a video printer capable of printing a color image on a printing paper about the size of a postal card: This video printer may use an ink ribbon having a sublimation dye or a molten pigment coated thereon. FIG. 1 shows an example of an ink ribbon using a sublimation dye.

As shown in FIG. 1, this ink ribbon 55 may comprise a ribbon body 56 formed of a belt-like transparent film and thermal dye belts 57 of predetermined length coated (printed) along the longitudinal direction of the ribbon body at a constant interval repeatedly. As the dye belts, there may be generally used yellow (Y) dye belts 57Y, magenta (M) dye belts 57M and cyan (C) dye belts 57C which are complementary colors. A picture change sensor mark 60Y may be formed on a vacant area 58Y provided ahead of the Y dye belt 57Y, and color change sensor marks 60M, 60C may be respectively formed on vacant areas 58M, 58C respectively provided ahead of the M dye belt 57M and the C dye belt 57C.

FIG. 2 is a diagram showing a video printer having an ink ribbon and a printing paper loaded thereon. The ink ribbon 55 of predetermined length may be wound around a supply spool 62, and a tip end thereof may be wound around a take-up spool 63. A roll-like printing paper 71 may be rotatably attached to a printing paper roll presser, not shown, through a paper spool 70. A thermal head 68 serving as a print head and a sensor mark detection means 72 for detecting the sensor marks 60Y, 60M, 60C may be disposed between the pair of spools 62, 63. A platen roller (platen) 69 may be disposed on the opposite side of the thermal head 68 across the ink ribbon 55. The platen 69 may cause the ink ribbon 55 to be urged against the thermal head 68, and may transport the printing paper 71 inserted between the platen 69 and the ink ribbon 55 in cooperation with transport rollers 73, 74.

Such video printer 75 should perceive that the roll-like printing paper 71 approaches to its end after the printing paper was supplied from the platen 69 or the like and the rewinding of the printing paper was finished. To this end, there has hitherto been proposed a method of perceiving the portion near the end of the printing paper 71 by a plurality of detection marks 77 formed near the end of the printing paper 71 as shown in FIG. 3 or a plurality of perforations 78 perforated near the end of the printing paper 71 so as to be detected by an optical sensor as shown in FIG. 4. FIGS. 3 and 4 are diagrams showing the roll-like printing paper from the rear side.

According to the method of perceiving the end of the printing paper by marks provided near the end of the printing paper or by the perforations that can be perceived by the optical sensor, additional manufacturing process such as forming the detection marks 77 on the roll-like printing paper continuously manufactured or forming the perforations 78 that can be perceived by the optical sensor should be required. Unavoidably, there arises a problem that the number of production process increases to lower a production efficiency.

Also, since the whole of the printing paper cannot be used because the printing paper has the portion in which the marks 77 are formed or the perforations 78 are formed, a loss of printing paper may increase. Further, since the end of the printing paper is perceived by the marks or the perforations formed near the end of the printing paper, even though the end of the printing paper can be perceived, a remaining quantity of printing paper could not be perceived in advance.

SUMMARY OF THE INVENTION

It is an object of the present invention to provide a roll-like printing paper in which the approach of the printing paper to the end can be detected and displayed without effecting special processing on the printing paper additionally to thereby solve the above-mentioned problems, a video printer using such roll-like printing paper and a method of detecting a remaining quantity of a printing paper.

A roll-like printing paper according to this invention is a roll-like printing paper wound around a paper spool in which the paper spool has formed thereon a detection portion for detecting a rotation.

A video printer according to the present invention comprises a detection portion provided on a paper spool around which a printing paper is wound so as to detect a rotation of the paper spool, a rotation detection means for detecting the rotation of the paper spool by the detection portion and a control means for determining based on the paper spool rotation detected by the rotation detection means whether or not a remaining quantity of the roll-like printing paper wound around the paper spool approaches to the end and displaying a first alarm on a display means if the remaining quantity of the roll-like printing paper approaches to the end.

A printing paper remaining quantity detection method according to the present invention comprises the step of detecting a rotation of a paper spool around which a printing paper is wound, determining based on the detection rotation of the paper spool whether or not the remaining quantity of the roll-like printing paper wound around the paper spool approaches to the end and displaying an alarm on a display means if it is determined that the remaining quantity of the roll-like printing paper approaches to the end.

The roll-like printing paper according to the present invention may become possible to detect the rotation of the paper spool by the detection portion provided on the paper spool.

In the video printer according to the present invention, when the rotation detection means detects the rotation of the paper spool by the detection portion provided on the paper spool, it is determined by the control means based on the detected rotation of the paper spool whether or not the remaining quantity of the roll-like printing paper wound around the paper spool approaches to the end. If it is determined that the remaining quantity of the roll-like printing paper approaches to the end, then the display means displays a first alarm.

The printing paper remaining quantity detection method according to the present invention comprises the step of detecting the rotation of the paper spool around which the printing paper is wound, determining based on the detected rotation of the paper spool whether or not the remaining quantity of the roll-like printing paper wound around the paper spool approaches to the end and displaying the alarm by the display means if it is determined that the remaining quantity of the roll-like printing paper approaches to the end.

DESCRIPTION OF THE PREFERRED EMBODIMENTS

A roll-like printing paper and a video printer using such roll-like printing paper according to embodiments of the present invention will hereinafter be described with reference to the drawings.

Figure 1:
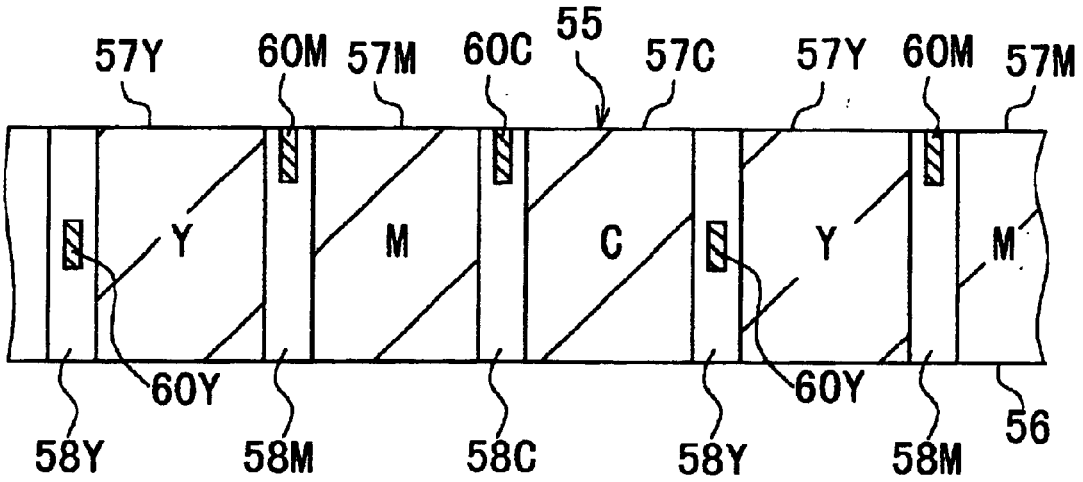
FIG. 1 is a diagram showing an example of an ink ribbon using a sublimation dye.
Figure 2:
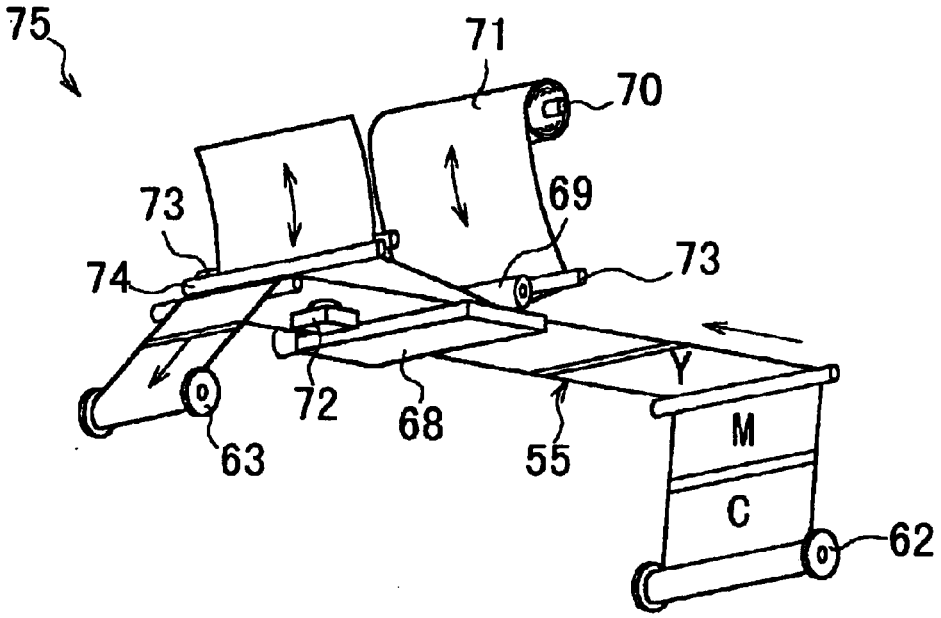
FIG. 2 is a diagram showing a video printer having a printing paper and an ink ribbon loaded thereon according to the prior art.
Figure 3:
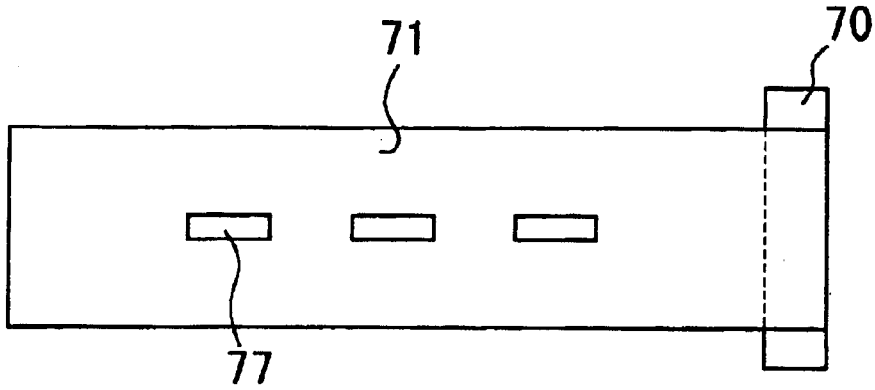
FIG. 3 is a diagram showing a printing paper in which detection marks are formed near the end of the printing paper.
Figure 4:
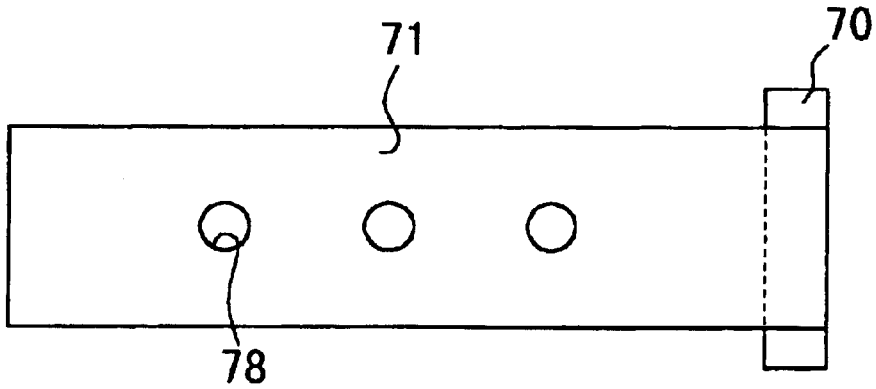
FIG. 4 is a diagram showing a printing paper in which perforations that can be detected by an optical sensor are perforated near the end of the printing paper.
Figure 5A:
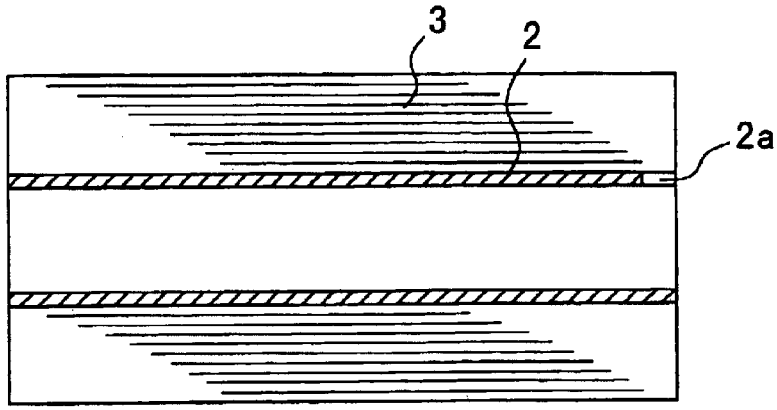
FIG. 5A is an elevational side view illustrating an example in which a paper spool of a roll-like printing paper and a printing paper have the same width according to the present invention.
Figure 5B:
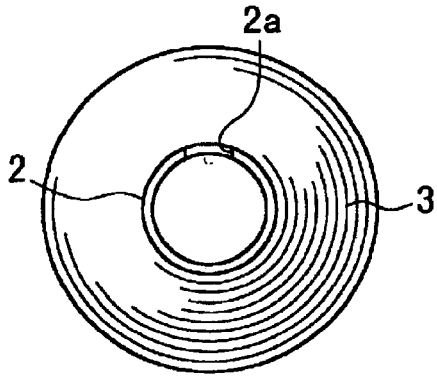
FIG. 5B is a front view thereof.
Figure 6:
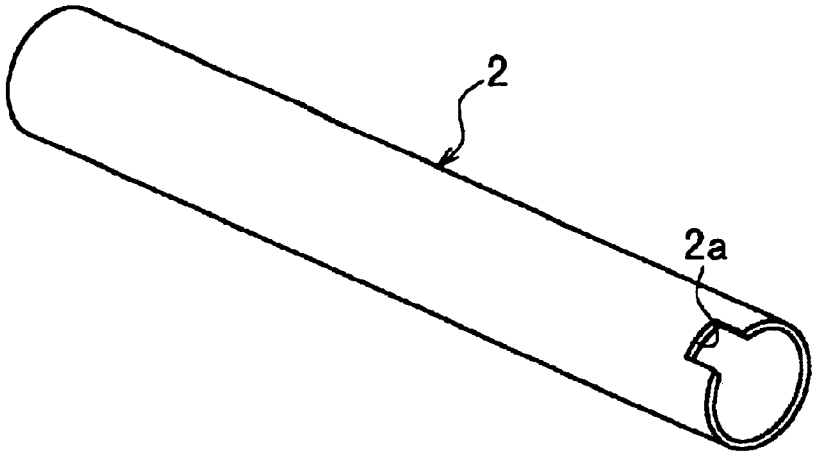
FIG. 6 is a perspective view illustrating a paper spool of a roll-like printing paper.
Figure 7:
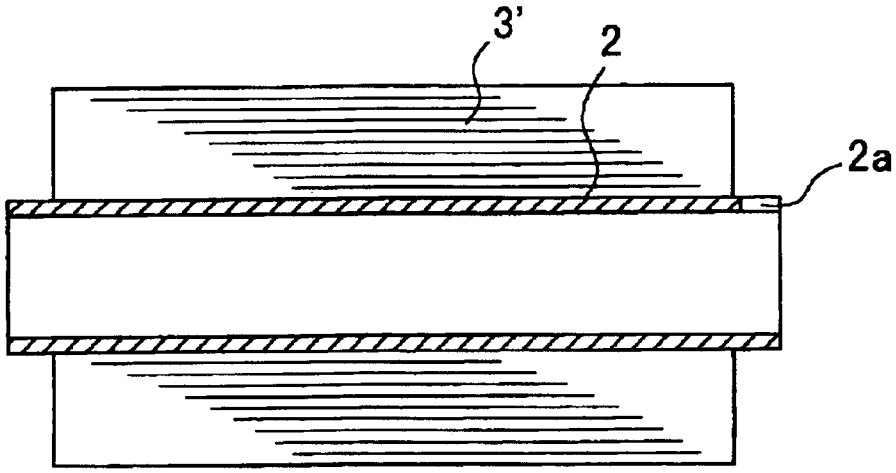
FIG. 7 is an elevational side view illustrating an example in which a paper spool of a roll-like printing paper and a printing paper according to the present invention have different widths.

FIG. 5A is an elevational side view illustrating an example in which a paper spool of a roll-like printing paper and a printing paper according to the present invention have the same width. FIG. 5B is a front view thereof. As shown in FIGS. 5A and 5B, a printing paper 3 having the same width may be wound around a paper spool 2, and the paper spool 2 may have formed on one side thereof a notch 2*a* serving as a detection portion to detect the rotation of the printing paper. FIG. 6 is a perspective view showing the paper spool of the roll-like printing paper. The paper spool 2 of the printing paper may have formed at its one end the notch 2*a* serving as the rotation detection portion. FIG. 7 is an elevational side view showing an example in which a paper spool and a printing paper may have different width. A printing paper 3' having a width narrower than that of the paper spool 2 may be wound around the paper spool 2.

Figure 8:
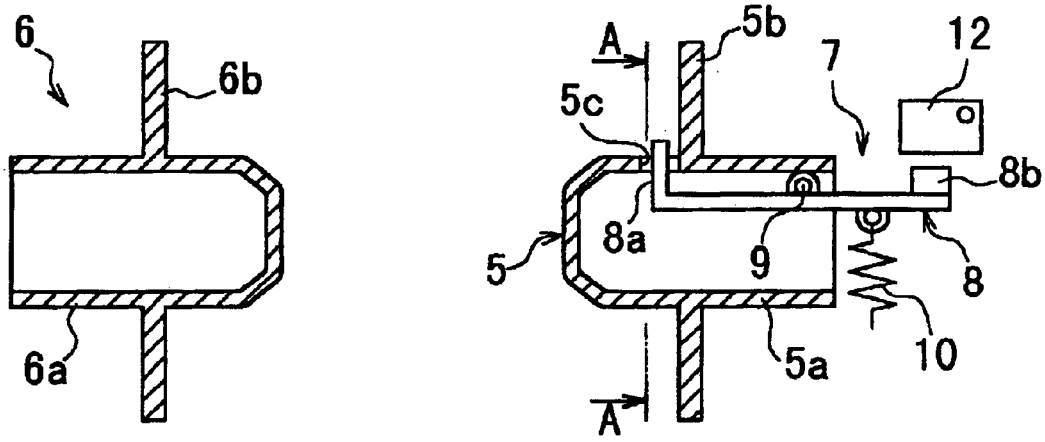
FIG. 8 is an elevational side view illustrating a rotation detector according to the present invention.
Figure 9:
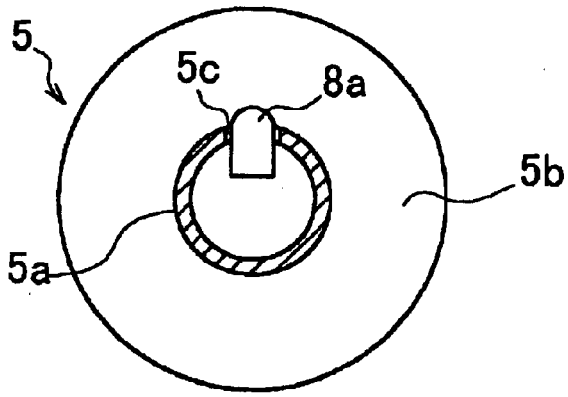
FIG. 9 is a cross-sectional view taken along the line A—A in FIG. 8.

FIG. 8 is an elevational side view showing a rotation detector serving as a printing paper rotation detection means. FIG. 9 is a cross-sectional view taken along the line A—A in FIG. 8. The paper spool 2 of the roll-like printing paper may be rotatably supported by a pair of printing paper roll pressers 5, 6. A pair of printing paper roll pressers 5, 6 may comprise shaft portions 5*a*, 6*a* and flange portions 5*b*, 6*b* formed around the shafts 5*a*, 6*a*.

The printing paper roll presser 5 on the side of a rotation detector may have a through-hole 5*c* for detecting the rotation of the paper spool 2 bored at its inside portion of the flange portion 5*b* of the shaft portion 5*a*.

A lever 8 of a rotation detector 7 serving as the rotation detection means may be supported within the shaft 5*a* of the printing paper roll presser 5 such that the lever 8 can be rotated (swung) about a pin 9 freely. The lever 8 may be shaped as an L-letter as seen from the side, and may comprise an L-letter-like contact 8*a* of the tip end and a detection portion 8*b* of the rear end. The contact portion 8*a* of the lever 8 may be translated into the through-hole 5*c* of the printing paper roll presser 5 under spring force of a spring 10 so that its tip end may be protruded from the through-hole 5*c*. On the other hand, the detection portion 8*b* of the other end of the lever 8 can be translated into or translated back from a detection optical sensor 12 as the lever 8 is rotated (swung). Then, the lever 8, the spring 10 and the detection optical sensor 12 may constitute the rotation detector 7. According to the present invention, the rotation detector 7 may detect the rotation of the paper spool 2 from the notch 2*a*. If it is determined that the remaining quantity of the printing paper approaches to the end, then the printing paper remaining quantity alarm may be displayed.

Figure 10:
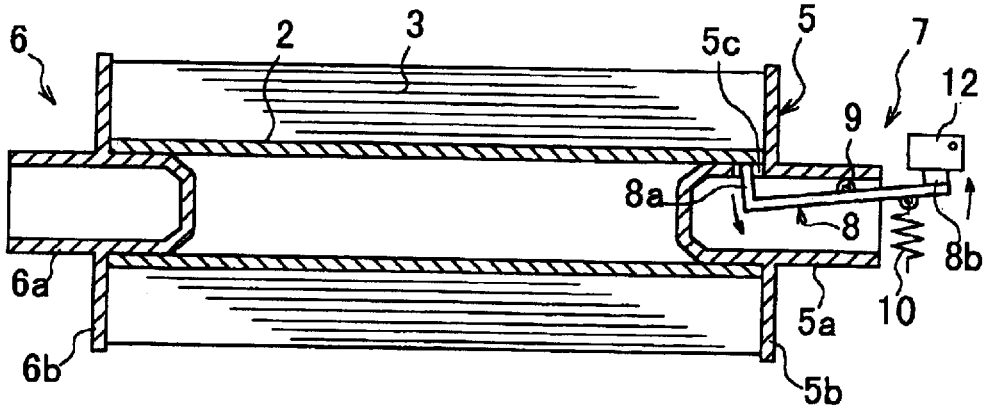
FIG. 10 is an elevational side view illustrating the state in which the roll-like printing paper wound around the paper spool is attached to the printing paper roll pressers.

FIG. 10 is an elevational side view showing the manner in which the roll-like printing paper 3 wound around the paper spool 2 is attached to the printing paper roll pressers 5, 6. The paper spool 2 of the roll-like printing paper 3 may be rotatably engaged with the outer peripheries of the tip end portions of the shaft portions 5*a*, 6*a* of the printing paper roll pressers 5, 6. When other portion than the notch 2*a* of the paper spool 2 opposes the through-hole 5*c* portion of the printing paper roll presser 5, the tip end of the contact portion 8*a* of the lever 8 may be brought in contact with the inner circumferential surface of the paper spool 2, whereby the contact portion 8*a* may be moved in the lower direction. Concurrently therewith, the detection portion 8*b* may be moved in the upper direction and may be entered into the detection optical sensor 12.

Figure 11:
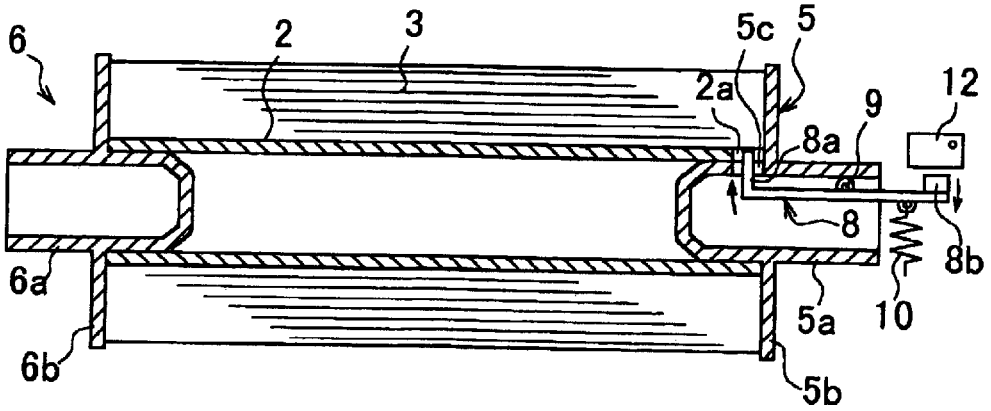
FIG. 11 is an elevational side view illustrating the state in which the notch of the paper spool is detected by the rotation detector.

Then, as shown in FIG. 11, when the paper spool 2 is rotated in accordance with the supply of the roll-like printing paper 3 to cause the notch 2*a* of the paper spool 2 to oppose the through-hole 5*c* portion of the printing paper roll presser 5, the tip end of the contact portion 8*a* of the lever 8 may enter into the notch 2*a* of the paper spool 2 to come in contact with the printing paper 3, whereby the contact portion 8*a* of the lever 8 may be moved in the upper direction. Concurrently therewith, the detection portion 8*b* of the lever 8 may be moved in the lower direction and thereby detached from the detection optical sensor 12. As described above, when the paper spool 2 is rotated once, since the detection portion 8*b* of the lever 8 may be entered into and retreated from the detection optical sensor 12 once, the detection optical sensor 12 may generate pulses in accordance with the rotation of the paper spool 2. Incidentally, while the detection optical sensor 12 is used as the rotation detection means as described above, the present invention is not limited thereto, and a microswitch can of course be used. Moreover, while the lever 8 can be freely rotated (swung) about the pin 9 as described above, the present invention is not limited thereto, and the pin 9 need not be provided and the projected portion of the lever 8 may be brought in contact with the inner surface of the paper spool 2, whereby this projected portion may permit the lever 8 to freely rotate (swing).

Figures 12A, 12B, 12C:
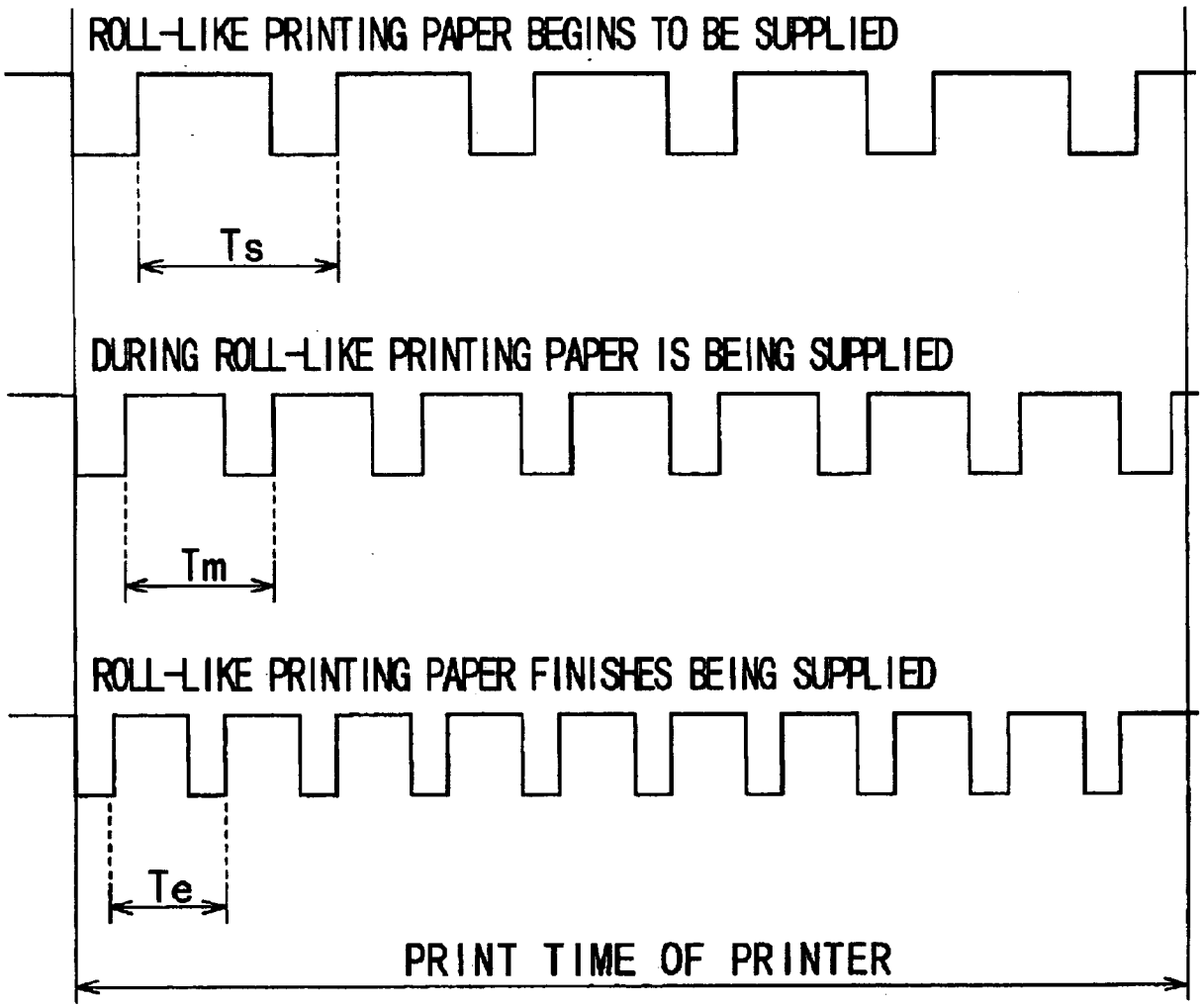
FIGS. 12A to 12C are respectively diagrams of waveforms of outputs from the detection optical sensor for detecting the rotation of the roll-like printing paper.

The manner in which the rotation of the roll-like printing paper is detected will be described next. FIGS. 12A to 12C are respectively diagrams of waveforms of outputs outputted from the optical sensor which can detect the rotation of the roll-like printing paper. The waveform of the output outputted from the optical sensor may delicately change in accordance with a winding diameter of the printing paper. As shown in FIG. 12A, for example, when the use of the roll-like printing paper is started, the winding diameter of the printing paper is large so that the printing paper 3 and the paper spool 2 are rotated slowly, thereby resulting in a pulse spacing Ts being increased. As shown in FIG. 12B, as the printing paper has been in use, the winding diameter of the printing paper decreases so that the rotational speed of the printing paper 3 and the paper spool 2 may increase, thereby resulting in a pulse spacing Tm being decreased progressively. Then, as shown in FIG. 12C, when the winding of the printing paper is ended, the winding diameter of the printing paper becomes minimum so that the rotational speed of the printing paper and the paper spool become maximum, thereby resulting in a pulse spacing Te being made shortest. In this manner, the remaining quantity of the printing paper 3 can be perceived by measuring the pulse spacing T (Ts, Tm, Te). Incidentally, a print time of a printer shown in FIG. 12C may be a time during which a color may be printed on the printing paper 3 by heating an ink ribbon 15 with a thermal head 29 while the printing paper 3 inserted between a platen 31 and an ink ribbon 15, which will be described later on, is being moved.

Figure 13:
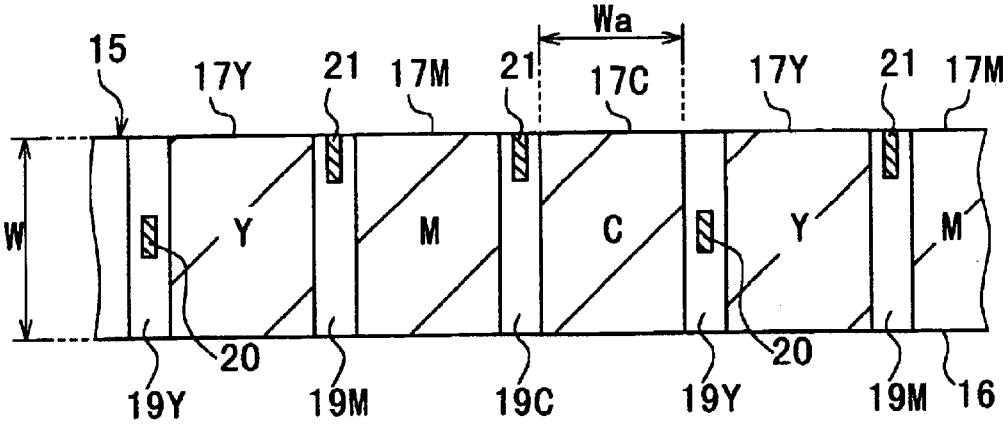
FIG. 13 is a diagram showing an example of an ink ribbon using a sublimation dye.

A video printer for printing a color image on a printing paper may use an ink ribbon with a sublimation dye or a molten pigment coated thereon. FIG. 13 is a diagram showing an example of an ink ribbon using a sublimation dye. The ink ribbon 15 may include a ribbon body 16 made of a belt-like transparent film on which thermal dye belts having a length Wa may be sequentially and repeatedly coated (printed) along the longitudinal direction of the ribbon body 16 at a constant interval. The dye belts may be generally complementary colors. There may be used a yellow (Y) dye belt 17Y, a magenta (M) dye belt 17M and a cyan (C) dye belt 17C.

A picture change sensor mark 20 having predetermined width and length may be formed within a vacant area 19Y located ahead of the Y dye belt 17Y at substantially the center position of an ink ribbon width W. Moreover, color change sensor marks 21 having predetermined width and length from the upper end face of the ink ribbon may be formed within vacant areas 19M, 19C located ahead of the M dye belt 17M and the C dye belt 17C.

Figure 14:
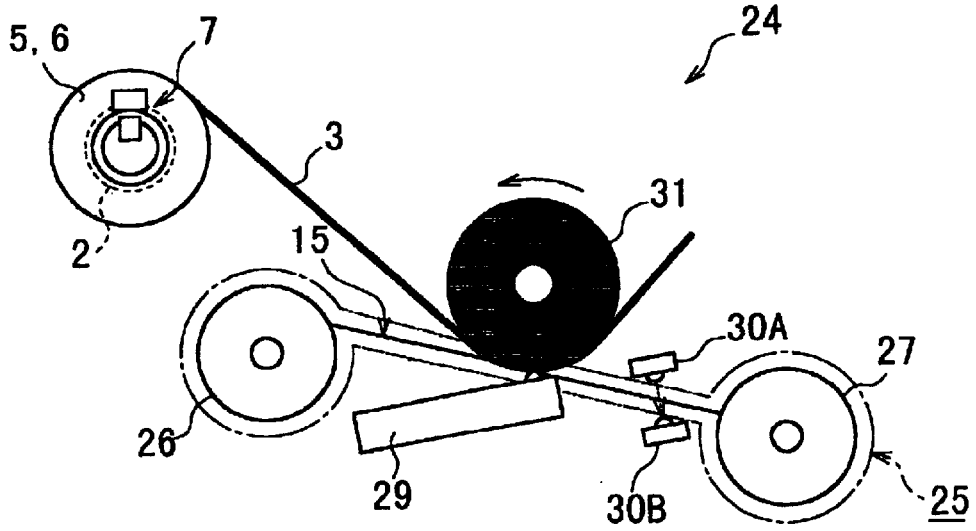
FIG. 14 is a diagram showing a cartridge housing therein an ink ribbon and a video printer having loaded thereon a printing paper.

FIG. 14 is a diagram showing a video printer to which a cartridge housing the ink ribbon and the printing paper are attached. The ink ribbon 15 may be housed within a cartridge 25 shown by a dot-and-dash line in FIG. 14 and loaded onto a video printer 24 when the ink ribbon is in use. The paper spool 2 of the roll-like printing paper 3 may be rotatably attached to the printing paper roll pressers 5, 6. In this video printer 24, when the cartridge 25 is loaded onto the printer body, a thermal head 29 serving as a print head and a sensor mark detection means 30 for detecting the above-mentioned sensor marks 20, 21 may be disposed between a pair of spools 26, 27 of the cartridge 25. As illustrated in FIG. 14, a light-emitting portion 30A and a light-receiving portion 30B may constitute the sensor mark detection means 30.

A platen roller (platen) 31 may be located on the opposite side of the thermal head 29 across the ink ribbon 15. The platen 31 may urge the ink ribbon 15 against the thermal head 29, and may transport the printing paper 3 stretched between the platen 31 and the ink ribbon 15 in cooperation with transport rollers (not shown).

Figure 15:
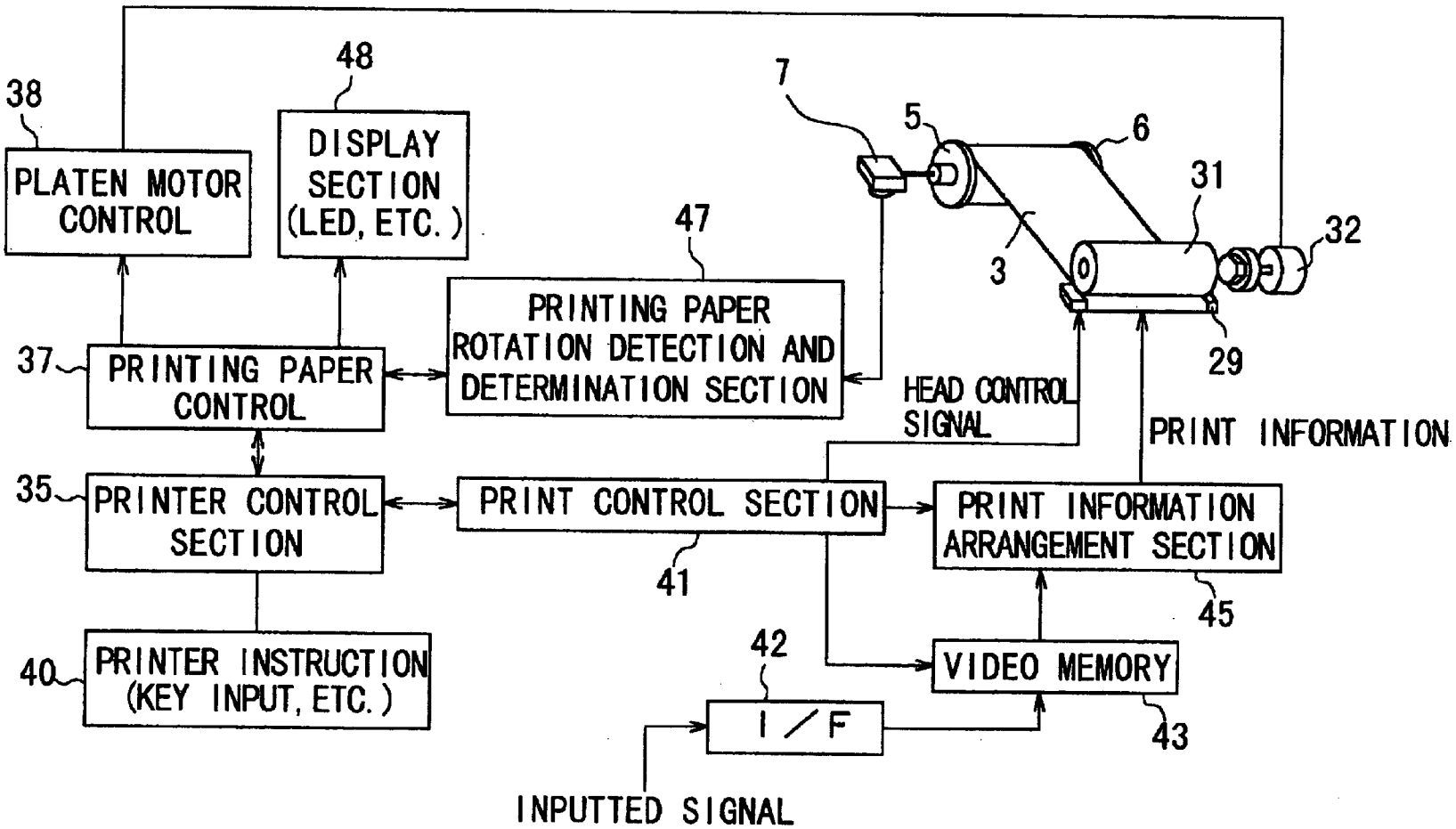
FIG. 15 is a block diagram showing a printer control circuit.

FIG. 15 is a block diagram of a printer control circuit. Initially, when the cartridge 25 is loaded onto the body of the video printer 24, a cartridge detection sensor (not shown) may detect this loading state. When the loading state is detected, the ink ribbon is rewound.

To this end, under control of a printer control section 35, a pair of ribbon winding and rewinding motors, not shown, are driven to rewind the ink ribbon. After the ink ribbon was wound and the sensor marks 20, 21, or the like were perceived by the sensor mark detection means 30, the ink ribbon is rewound and the printer control circuit is placed in the standby mode at a time in which the sensor mark 20 is detected again. This may become a print standby mode.

At the same time this ribbon loading processing is executed, the printer control section 35 may output a printing paper feed processing signal to a printing paper control section 37. In response to the feed processing signal from the printing paper control section 37, a platen motor control section 38 may drive a platen motor 32 such that the printing paper 3 may be wound around the platen 31 or that the platen 31 to which the printing paper 3 was wound may be rotated up to the print start position (standby position).

When a print instruction is issued from a key input section (operation panel section) 40 and this print instruction is entered into the printer control circuit, a print start instruction signal may be supplied to the printer control section 35. When the print start instruction signal is supplied to the printer control section 35, initially, a read instruction of a printed signal may be supplied through a print control section 41 to an interface 42, whereby print information from a signal source connected to this interface 42 may be stored in a video memory 43. When print information is video print data, a printed signal may be a video signal. When print information is digital print data, a printed signal may be a digital signal conforming to the SCSI format and the GP-IB format.

The memorized print information may be processed by a print information arrangement section 45 in a variety of image processing fashions suitable for printing. This image processing may cover a processing in which image information may be converted into respective Y, M, C correction signals to the correction processing based on image correction coefficients (coefficients used to correct a print density and a color tone).

Although print information read out from the print information arrangement section 45 is supplied to the thermal head 29 serving as the print head, only print information (Y signal, M signal and C signal) corresponding to colors (Y, M, C) of dyes formed on the ink ribbon may be read out, and image contents based on such print information may be printed on the printing paper 3 in a surface-sequential scanning fashion. To this end, the platen 31 may be rotated by a predetermined angle at every color in the opposite direction to return the printing paper 3 to the print start position.

On other hand, when a print start instruction signal is supplied to the printer control section 35 from the key input section (operation panel section) 40, the printer control section 35 may output a rotation detection timer start signal for detecting the rotation of the printing paper 3 to the printing paper control section 37, and also may output a feed processing signal of the printing paper 3. In response to the feed processing signal supplied thereto from the print control section 35 through the printing paper control section 37, a platen control section 38 may drive the platen motor 32 of the platen 31 to rotate the platen 31.

When the platen 31 is rotated, the roll-like printing paper 3 may be supplied and the paper spool 2 may be rotated concurrently. When the paper spool 2 is rotated, the notch 2*a* of the paper spool 2 also may be rotated and the lever 8 of the rotation detector 7 also may be swung concurrently so that the rotation of the paper spool 2 can be detected by the detection optical sensor 12. A rotation detection signal from the rotation detector 7 may be inputted to a printing paper rotation detection and determination section 47, in which it may be counted by a rotation detection timer, not shown, to thereby judge an available quantity of the printing paper 3. A signal from the printing paper rotation detection and determination section 47 may be outputted to the printing paper control section 37. If it is determined by the printing paper rotation detection and determination section 47 based on the rotation detection signal from the rotation detector 7 that the remaining quantity of the printing paper approaches to its end, then a printing paper end message, which is a first alarm, may be displayed on a display section 48 formed of a two-dimensional liquid-crystal display element or an LED (light—light emitting diode) serving as a display means under control of the outputted signal from the printing paper control section 37.

Figure 16:
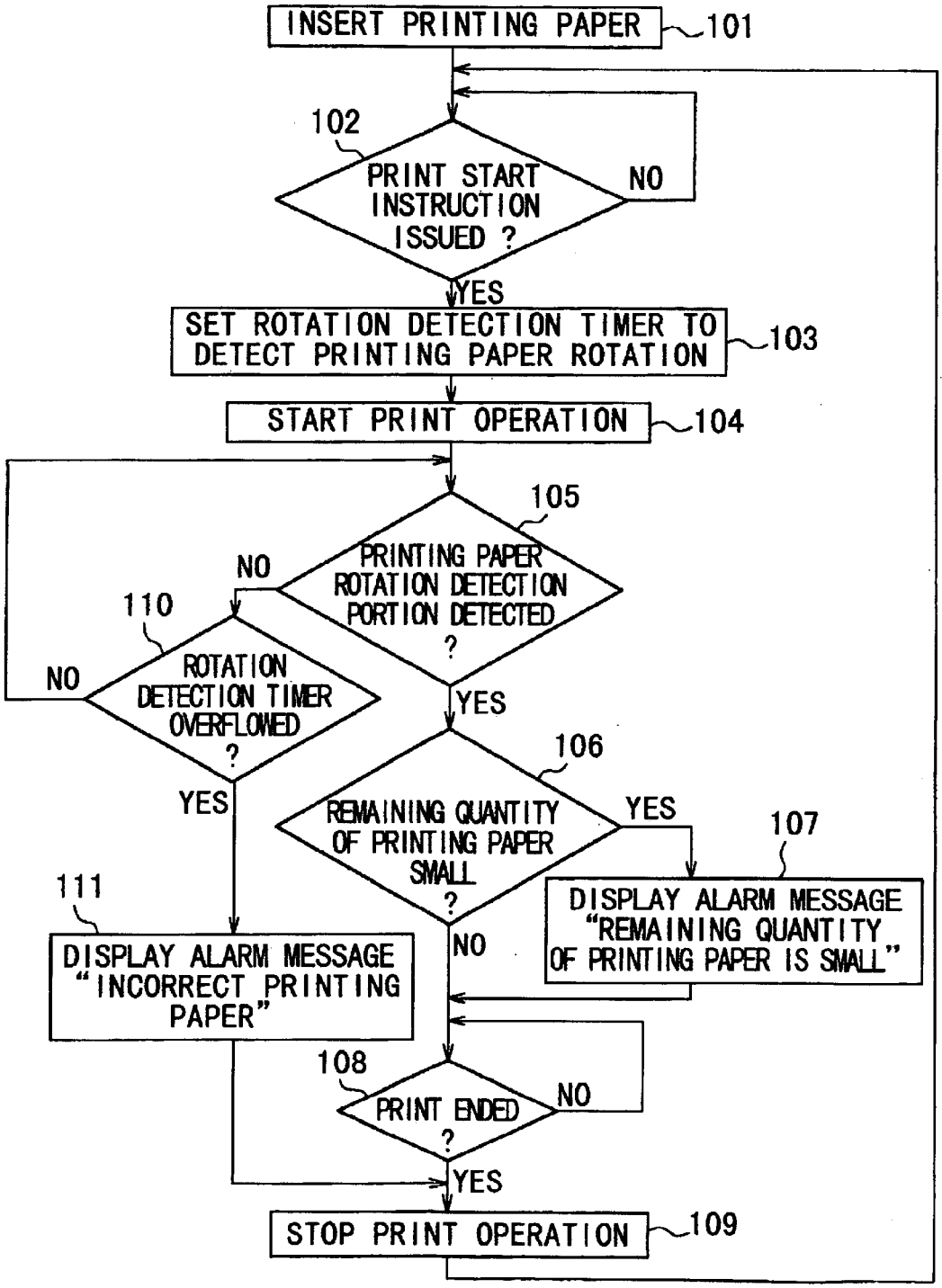
FIG. 16 is a flowchart to which reference will be made in explaining an operation of a video printer according to the present invention.

FIG. 16 is a flowchart to which reference will be made in explaining an operation of a video printer according to the present invention.

As shown in FIG. 16, initially, at a step 101, the tip ends of the shaft portions 5*a*, 6*a* of the pair of printing paper roll pressers 5, 6 may be inserted into the paper spool 2 of the roll-like printing paper 3 and set. Then, the printing paper 3 may be wound around the platen 31, and the platen 31 around which the printing paper 3 was wound may be rotated up to the printing start position (standby position). Control goes to the next decision step 102, whereat it is determined whether or not the printing start instruction is issued. If the printing start instruction is issued as represented by a YES at the decision step 102 under the printing start instruction standby state, then control goes to a step 103, whereat the rotation detection timer for detecting the rotation of the printing paper 3 may be set, and then started. Then, control goes to a step 104, whereat the platen motor 32 may be driven to rotate the platen 31 to supply the roll-like printing paper 3, thereby resulting in the printing operation being started. When the printing paper 3 is supplied, the paper spool 2 may be rotated and the notch 2*a* of the paper spool 2 may also be rotated so that the lever 8 of the rotation detector 7 also may be swung concurrently. As a consequence, the rotation detector 7 can detect the rotation of the paper spool 2 by detecting the swinging of the lever 8 with the detection optical sensor 12.

Then, it is determined at the next decision step 105 whether or not the notch 2*a* serving as the rotation detection portion for detecting the rotation of the paper spool 2 of the roll-like printing paper 3 is detected by the lever 8 of the rotation detector 7. If the notch 2*a* of the paper spool 2 is detected by the lever 8, then the pulse time spacing is detected. Then, control goes to the next decision step 106, whereat it is determined based on the pulse time spacing thus detected whether or not the remaining quantity of the roll-like printing paper 3 is small, i.e. whether or not the roll-like printing paper 3 approaches to its end. If it is determined at the decision step 106 based on the pulse time spacing thus detected that the remaining quantity of the roll-like printing paper 3 is small, i.e. that the roll-like printing paper 3 approaches to its end, then control goes to a step 107, whereat an alarm message indicating "REMAINING QUANTITY OF PRINTING PAPER IS SMALL", which is the first alarm, may be displayed on the display section 48.

Then, control goes to the next decision step. 108, whereat it is determined whether or not the printing is finished. If the printing is ended as represented by a YES at the decision step 108, then control goes to a step 109, whereat a printing stop operation is executed. Then, control goes back to the step 102, whereat the video printer is placed in the print start instruction standby mode.

If on the other hand it is determined at the decision step 105 that the notch 2*a* of the paper spool 2 is not detected by the lever 8 of the rotation detector 7, then control goes to the next decision step 110. At the decision step 110, it is determined whether or not the rotation detection timer overflows. If the rotation detection timer overflows as represented by a YES at the decision step 110, then control goes to a step 111, whereat an alarm message indicating "PRINTING PAPER IS NOT CORRECT", which is a second alarm, may be displayed on the display section 48. Since the notch 2*a* is formed on one side of the paper spool 2, if the paper spool 2 of the roll-like printing paper 3 is attached to the incorrect direction or if a paper spool having no notch provided as a detection portion is attached, then the notch 2*a* cannot be detected at all, and hence the rotation detection timer overflows, thereby resulting in the alarm being displayed.

If it is determined at the decision step 110 that the rotation detection timer does not overflow, then control goes back to the decision step 105, whereat it is determined whether or not the notch 2*a* of the paper spool 2 is detected.

Accordingly, the lever 8 of the rotation detector 7 is swung by the notch 2*a* of the rotating paper spool 2 and the swinging of the lever 8 is detected by the detection optical sensor 12, whereby the rotation detector 7 can rotate the rotation of the paper spool 2. If it is determined based on the rotation spacing detected by the rotation detector 7 that the remaining quantity of the roll-like printing paper 3 is small, i.e. the roll-like printing paper 3 approaches to its end, then the alarm message indicating "REMAINING QUANTITY OF PRINTING PAPER IS SMALL" may be displayed on the display section 48. Therefore, a user can perceive in advance that the printing paper approaches to its end, and hence it is possible to prevent the printing paper from becoming short.

Since the paper spool 2 has formed thereon the notch 2*a* serving as the rotation detection portion, the additional manufacturing processing such as forming marks or perforations on the roll-like printing paper 3 itself should not be required unlike the prior art. Therefore, the number of manufacturing process for producing roll-like printing papers can be prevented from increasing or a production efficiency can be prevented from being lowered. Further, since the detection marks or the perforations are not formed near the end of the roll-like printing paper 3, the loss of the printing paper can be reduced.

Since the notch 2*a* is formed on one side of the paper spool 2, if a user attaches the paper spool 2 of the roll-like printing paper 3 incorrectly, then the rotation detector 7 does not detect the rotation. Therefore, the incorrect loading and improper roll-like printing paper can be detected, and this incorrect loading can be displayed on the display section.

The paper spool detection section for detecting the rotation of the roll-like printing paper and the rotation detection means according to a second embodiment of the present invention will be described next.

Figure 17:
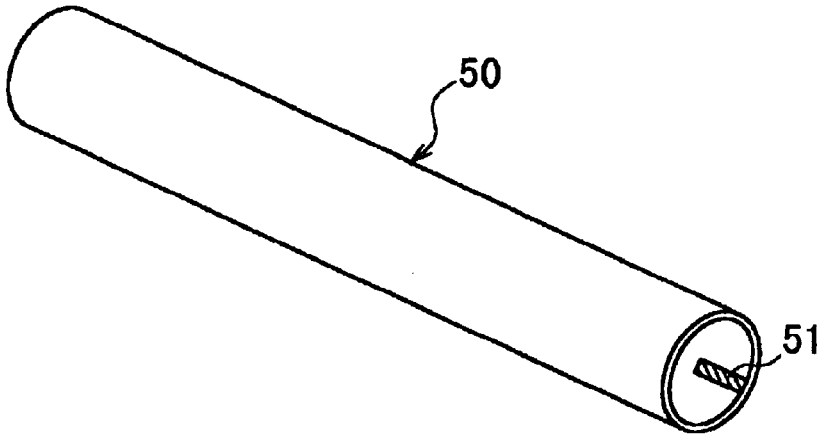
FIG. 17 is a perspective view illustrating a paper spool detection portion according to a second embodiment of the present invention.

FIG. 17 shows a paper spool detection portion according to the second embodiment of the present invention wherein a bar code 51 serving as a detection portion may be attached to the inner surface of one opening end of a paper spool 50. The bar code 51 may be directly printed on the paper spool 50 or a sticker with the bar code 51 printed thereon may be attached to the inner surface of the paper spool 50.

Figure 18:
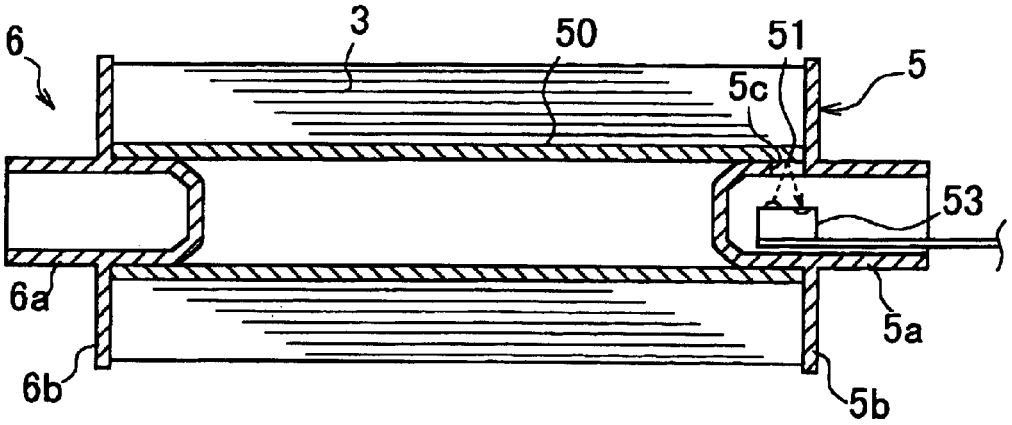
FIG. 18 is an elevational side view illustrating a rotation detection means according to the second embodiment of the present invention.

FIG. 18 is an elevational side view showing a rotation detection means according to the second embodiment of the present invention. The paper spool 50 of the roll-like printing paper 3 may be rotatably supported by the pair of printing paper roll pressers 5, 6. The pair of the printing paper roll pressers 5, 6 may be the same as those of the above-mentioned first embodiment. The through-hole 5*c* for detecting the rotation of the paper spool 2 may be formed on the printing paper roll presser 5 of the rotation detection means at its portion inside from the flange portion 5*b* of the shaft portion 5*a*.

The printing paper roll presser 5 may have formed within its shaft portion 5*a* a detection optical sensor serving as a rotation detection means opposed to the through-hole 5*c*. This detection optical sensor 53 may be adapted to detect the bar code 51 which passes the portion of the through-hole 5*c*.

When the paper spool 50 is rotated to cause the bar code 51 of the paper spool 50 to oppose the portion of the through-hole 5*c* of the printing paper roll presser 5 as the printing paper 3 is supplied, the detection optical sensor 53 may detect such bar code 51, and the detection optical sensor 53 may generate pulses. A rest of elements and parts other than the bar code 51 serving as the detection portion and the detection optical sensor 53 serving as the rotation detection means may be arranged similarly to that of the above-mentioned video printer according to the first embodiment.

Accordingly, since the rotation of the paper spool 50 can be detected by only reading the bar code 51, there can be achieved particular effects that the arrangement is simple and a trouble scarcely occurs. Also, since the bar code 51 is read out by the detection optical sensor 53 serving as the bar code reader, it is possible to discriminate roll-like printing papers 3 by the bar code 51 thus read.

While the bar code 51 is attached to the inner surface of the paper spool 50 according to the second embodiment, the present invention is not limited thereto, and there can of course be used other marks capable of detecting the rotation. Moreover, while the bar code 51 is attached to the inner surface of one opening end of the paper spool 50 as described above, the present invention is not limited thereto, and a bar code extending in the shaft direction may be attached to the inner surface of the paper spool 50.

Also, while the first and second alarms are displayed on the display section according to the first and second embodiments, the present invention is not limited thereto, and the first and second alarms based on voice or dial tone may be emanated from a speaker or the like.

Further, while an image is printed on the printing paper by the ink ribbon using the sublimation dye or the molten pigment according to the above-mentioned first and second embodiments, the present invention is not limited thereto, and the video printer may of course be arranged such that a thermal paper can be used as the printing paper.

As set forth above, according to the roll-like printing paper of the present invention, it becomes possible to detect the rotation of the paper spool by the detection portion formed on the paper spool.

According to the video printer and the printing paper remaining quantity detection method of the present invention, when the rotation detection means detects the rotation of the paper spool by the detection portion provided on the paper spool, if it is determined by the control means based on the detected rotation of the paper spool whether or not the remaining quantity of the roll-like printing paper wound around the paper spool approaches to its end. If it is determined that the remaining quantity of the roll-like printing paper approaches to its end, then the first alarm may be displayed on the display means so that a user can perceive in advance that the printing paper approaches to its end. Thus, it is possible to reliably prevent the printing paper from becoming short.

Also, when the detection portion is formed on one side of the paper spool, if the paper spool of the roll-like printing paper is attached incorrectly, then the rotation detection means cannot detect the rotation. Therefore, the incorrect attachment and the improper roll-like printing paper can be detected and the second alarm can be displayed by the display means, thereby making it possible to prevent the incorrect loading of the roll-like printing paper.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A video printer comprising, a detection portion disposed in a paper spool around which a printing paper is wound for determining a rotation of said paper spool;

rotation detection means for detecting a rotation of said paper spool by use of said detection portion; and control means for determining based on said paper spool rotation detected by said rotation detection means whether or not a remaining quantity of said printing paper wound around said paper spool approaches to its end and controls display means such that said display means displays a first alarm if it is determined that the quantity of said printing paper approaches its end;

wherein said detection portion is disposed on one side of said paper spool and said control means controls said display means such that said display means displays a second alarm if a rotation of said paper spool is not detected by said rotation detection means.

2. The video printer according to claim 1, wherein said detection portion comprises a bar code and said rotation detection means comprises an optical sensor.

3. The video printer according to claim 2, wherein said one side is an inside of said paper spool.

4. The video printer according to claim 1, wherein said detection portion comprises a bar code printed on said paper spool.

5. The video printer according to claim 1, wherein said detection portion comprises a bar code sticker affixed to said printer spool.

6. The video printer according to claim 1, wherein said detection portion comprises a through hole cut into the paper spool.

7. The video printer according to claim 6, wherein the rotation detection means comprises a lever with contact tip configured to detect passing of the through hole during rotation of the paper spool.

8. The video printer according to claim 7, wherein the lever is L-shaped and under a spring-like force that pushes the contact tip into the through hole.

9. The video printer according to claim 1, wherein the control means determines the remaining quantity of said printing paper based on a rotational speed of said paper spool.

10. The video printer according to claim 1, wherein:

the rotation detection means produces a pulse wave form indicating a rotational speed of said paper spool; and the control means determines the remaining quantity of said printing paper based on the rotational speed.

11. A video printer comprising:

a roll-like printing paper including a detection portion disposed in a paper spool to which the printing paper is wound in a roll-like fashion, printing paper roll pressers for rotatably supporting said paper spool and rotation detection means for detecting a rotation of said paper spool based on said detection portion; and control means for, determining based on said paper spool rotation detected by said rotation detection means whether or not a remaining quantity of said roll-like printing paper wound around said paper spool approaches its end and displaying an alarm on display means if it is determined that the remaining quantity of said roll-like printing paper approaches its end, and determining if said roll-like printing paper is rotating during printer operation based on said rotation detection means and displaying a second alarm on the display means if it is determined that said roll-like printing paper is not rotating during printer operation.

12. A method of detecting a remaining quantity of a printing paper comprising the steps of, detecting a rotation of a paper spool around which the printing paper is wound;

determining based on said detected paper spool rotation whether or not the remaining quantity of said printing paper wound around said paper spool approaches its end; and displaying a first alarm by display means if it is determined that the remaining quantity of said printing paper approaches its end;

wherein:

the rotation of said paper spool around which said printing paper is wound in a roll-like fashion is detected and a second alarm is displayed by display means if said paper spool rotation is not detected; and said step of detecting comprises detecting a detection portion disposed in said paper spool.

13. The method according to claim 12, wherein said step of detecting comprises reading the detection portion.

14. The method according to claim 12, wherein said step of detecting comprises reading the detection portion which comprises a bar code.

15. A video printer, comprising:

a paper spool, comprising, a detection portion disposed in the paper spool, and printing paper roll pressers for rotatably supporting the paper spool;

printing paper provided on said paper spool to which the printing paper is wound in a roll-like fashion;

rotation detection means for detecting a rotation of the paper spool by detecting the detection portion; and control means for determining, based on the paper spool rotation detected by the rotation detection means, whether or not a remaining quantity of the printing paper approaches its end and displaying a first alarm on a display means if it is determined that the remaining quantity of the printing paper approaches its end;

wherein said control means displays a second alarm on said display means if said rotation detection means does not detect the rotation of said paper spool.

16. The video printer according to claim 15, wherein the detection portion is formed on one side of said paper spool.

17. The video printer according to claim 15, wherein the detection portion comprises a bar code.

18. The video printer according to claim 15, wherein the rotation detection means comprises an optical scanner.

19. The video printer according to claim 15, wherein the detection portion comprises a through hole in the spool and the rotation detection means comprises a spring pressured L shaped lever configured to be pushed into the through hole on each rotation of the spool.

* * * * *